US006153982A

United States Patent [19]

Reiners

[11] Patent Number: 6,153,982

[45] Date of Patent: Nov. 28, 2000

[54] DISCHARGE LAMP AND LIGHTING SYSTEM HAVING A DISCHARGE LAMP

[75] Inventor: Thomas Reiners, Bachhagel, Germany

[73] Assignee: Patent-Treuhand-Gesellschaft fuer elektrische Gluehlampen mbH, Munich, Germany

[21] Appl. No.: 09/379,427

[22] Filed: Aug. 23, 1999

[30] Foreign Application Priority Data

Sep. 29, 1998 [DE] Germany ..... 198 44 548

[51] Int. Cl.[7] ..... H05B 41/16

[52] U.S. Cl. ..... 315/248; 313/595

[58] Field of Search ..... 315/248, 56, 344, 315/59; 313/51, 112, 113, 255, 595, 596, 621, 491, 492; 362/255

[56] References Cited

U.S. PATENT DOCUMENTS

| | | | |
|---|---|---|---|
| 3,932,783 | 1/1976 | Menelly et al. | 313/492 |
| 4,129,802 | 12/1978 | Vrenken et al. | 313/492 |
| 4,227,113 | 10/1980 | Walsh | 313/112 |
| 4,315,186 | 2/1982 | Hirano et al. | 313/111 |
| 4,506,194 | 3/1985 | Rigden et al. | 315/200 R |
| 4,568,859 | 2/1986 | Houkes | 315/248 |
| 5,003,214 | 3/1991 | Morris | 313/25 |
| 5,287,258 | 2/1994 | Remus | 362/256 |
| 5,420,481 | 5/1995 | McCanney . | |
| 5,702,179 | 12/1997 | Sidwell et al. | 362/255 |
| 5,811,914 | 9/1998 | Eijkens | 313/51 |
| 5,982,078 | 11/1999 | Krisl et al. | 313/112 |
| 6,051,926 | 4/2000 | Tamura | 313/567 |

FOREIGN PATENT DOCUMENTS

| | | |
|---|---|---|
| 0 334 208 | 9/1989 | European Pat. Off. . |
| 04043547 | 2/1992 | European Pat. Off. . |
| 0 512 622 A1 | 11/1992 | European Pat. Off. . |
| 0 660 375 A2 | 6/1995 | European Pat. Off. . |
| 0 673 057 A2 | 9/1995 | European Pat. Off. . |
| 0 767 340 A2 | 4/1997 | European Pat. Off. . |

*Primary Examiner*—Don Wong
*Assistant Examiner*—Trinh Vo Dinh
*Attorney, Agent, or Firm*—William E. Meyer

[57] ABSTRACT

The invention relates to a discharge lamp whose discharge vessel (1) is provided with a light-transmitting, electrically conductive layer (4) in order to improve the electromagnetic compatibility of the lamp when it is operated from an electronic operating unit. The light-transmitting, electrically conductive layer (4) is advantageously connected to the circuitry-internal ground potential of the operating unit.

13 Claims, 3 Drawing Sheets

DISCHARGE LAMP AND LIGHTING SYSTEM HAVING A DISCHARGE LAMP

The invention relates to a discharge lamp in accordance with the preamble of patent claim 1, and also to a lighting system having a discharge lamp.

BACKGROUND ART

A discharge lamp of this type is disclosed for example in the U.S. Pat. No. 5,420,481. This patent specification describes a discharge lamp which has outer electrodes fitted on its discharge vessel, said outer electrodes being designed as transparent ITO layers.

The European Patent Specification EP 0 334 208 describes a discharge lamp which is arranged in a reflector and whose discharge vessel is surrounded by a cylindrical vitreous heat accumulation tube. The heat accumulation tube is provided with an ITO layer in order to reduce the color temperature of the lamp by approximately 600 kelvin.

The abovementioned discharge lamps have the disadvantage that their operation from an electronic operating unit, which usually feeds the lamp with a medium-frequency supply voltage in the range of from approximately 20 kHz to 100 kHz, can interfere with the reception of radio sets.

SUMMARY OF THE INVENTION

The object of the invention is to provide a discharge lamp which avoids the disadvantages of the prior art. This object is achieved according to the invention by means of the defining features of patent claim 1. Particularly advantageous embodiments of the invention are described in the subclaims.

The discharge lamp according to the invention has at least one light-transmitting lamp vessel enclosing the discharge space of the discharge lamp, a luminous means and electrical terminals for supplying it with voltage. According to the invention, the at least one lamp vessel has a light-transmitting electrically conductive layer enclosing at least the discharge space of the lamp. The discharge space is in this case understood to mean only that part of the interior space of the at least one lamp vessel which is effective for the gas discharge in the lamp. Therefore, the coating according to the invention extends at least over those parts of the at least one lamp vessel which enclose the discharge plasma. As a result of the at least one lamp vessel being coated according to the invention, the medium-frequency electromagnetic radiation emitted by the discharge plasma enclosed in the lamp vessel is attenuated by more than 50 decibels in the case where the discharge lamp is operated from a medium-frequency AC voltage. Interference with the radio reception does not take place, therefore, even when the discharge lamp according to the invention is operated from an electronic operating unit in proximity to the antenna of a radio receiver.

For reasons of production engineering, the light-transmitting, electrically conductive layer is advantageously applied on the outer surface of the at least one lamp vessel. In order to ensure satisfactory electromagnetic compatibility of the discharge lamp according to the invention, the surface resistivity of the light-transmitting, electrically conductive layer is advantageously less than 100 ohms per square.

The surface resistivity of an electrically conductive layer is usually measured with the aid of two extensive electrodes which are applied on the layer to be measured such that they are arranged opposite one another. The distance between the two measuring electrodes is identical to the width of the measuring electrodes, with the result that a square patch of the layer to be measured is arranged between the two measuring electrodes. A current of predetermined current intensity is impressed on the layer via the measuring electrodes and the voltage drop across the measuring electrodes is determined by means of a galvanometer. The quotient of the measured voltage drop and the current intensity of the impressed current yields the surface resistivity of the layer to be measured. The surface resistivity of the layer is independent of the size of the square areal patch of the layer. It depends only on the quotient of the electrical resistivity of the layer material and the layer thickness. The unit of surface resistivity is usually denoted by ohms per square.

The light-transmitting, electrically conductive layer is advantageously designed as an ITO layer, that is to say as an indium tin oxide layer. The particularly preferred exemplary embodiment of the invention concerns a discharge lamp which emits predominantly yellow, orange or red light. Therefore, the layer thickness of the light-transmitting, electrically conductive layer is advantageously chosen such that the coated lamp vessel has the highest possible transparency, that is to say a transmission coefficient of greater than 0.8, in the wavelength range of from 550 nm to 700 nm. This is because the thickness of the light-transmitting, electrically conductive layer must be large enough to ensure a sufficient electrical conductivity, on the one hand, but also be small enough that it still exhibits sufficient light transmission, on the other hand. In accordance with the particularly preferred exemplary embodiment of the invention, the discharge lamp is designed as a neon gas discharge lamp. This lamp produces predominantly orange or red light. Therefore, it may advantageously be used as part of a lighting system in a motor vehicle, for the purpose of producing the flashing light or the rear and/or brake light.

The lighting system according to the invention has a discharge lamp and an operating unit for the discharge lamp, the discharge lamp having at least one lamp vessel which encloses the discharge space of the lamp and is provided with a light-transmitting, electrically conductive layer, this layer extending at least across the discharge space and being connected to a predetermined electrical reference-ground potential, which is advantageously the circuitry-internal ground potential of the operating unit 20 or the ground potential. The abovementioned features of the lighting system according to the invention ensure its satisfactory electromagnetic compatibility since the medium-frequency electromagnetic radiation emitted by the discharge plasma of the discharge lamp is attenuated by more than 50 decibels. It is advantageous for the lighting system according to the invention additionally to have a reflector. In order to obtain a high degree of light reflection, the reflector of the lighting system according to the invention advantageously has a metallic or metallized reflecting surface. Therefore, the reflector likewise has a shielding effect on the electromagnetic radiation generated by the discharge plasma in the discharge lamp. It has proved to be particularly advantageous to likewise connect the reflector and possibly metallized parts of the luminaire housing to the predetermined electrical reference-ground potential in order to improve the shielding. As a result, the layer thickness of the light-transmitting, electrically conductive layer on the wall regions of the at least one lamp vessel which face the reflector or the inner space of the luminaire may advantageously be made smaller than that on the wall regions of the at least one lamp vessel which are remote from the reflector, and, in this way, the light transmission of the wall regions facing the reflector can be increased and the efficiency of the lighting system according to the invention improved. The at least one lamp vessel advantageously has a cylindrical vessel part and two ends angled away in the direction of the reflector. This ensures that the dark ends of the discharge lamp which are equipped with the electrical terminals of the lamp are not visible. As an alternative, the dark ends of the discharge lamp may also be installed in shaded regions of the lighting apparatus.

In the particularly preferred exemplary embodiment of the lighting system according to the invention, the layer thickness of the light-transmitting, electrically conductive layer on the wall regions of the at least one lamp vessel which are remote from the reflector is 300 nm. As a result, these wall regions have particularly high transparency to light with a wavelength of 600 nm. Therefore, this lighting system is advantageously suitable for use in a motor vehicle for the purpose of producing the rear light and/or the brake light.

DESCRIPTION OF THE PREFERRED EMBODIMENT

Figure 1:
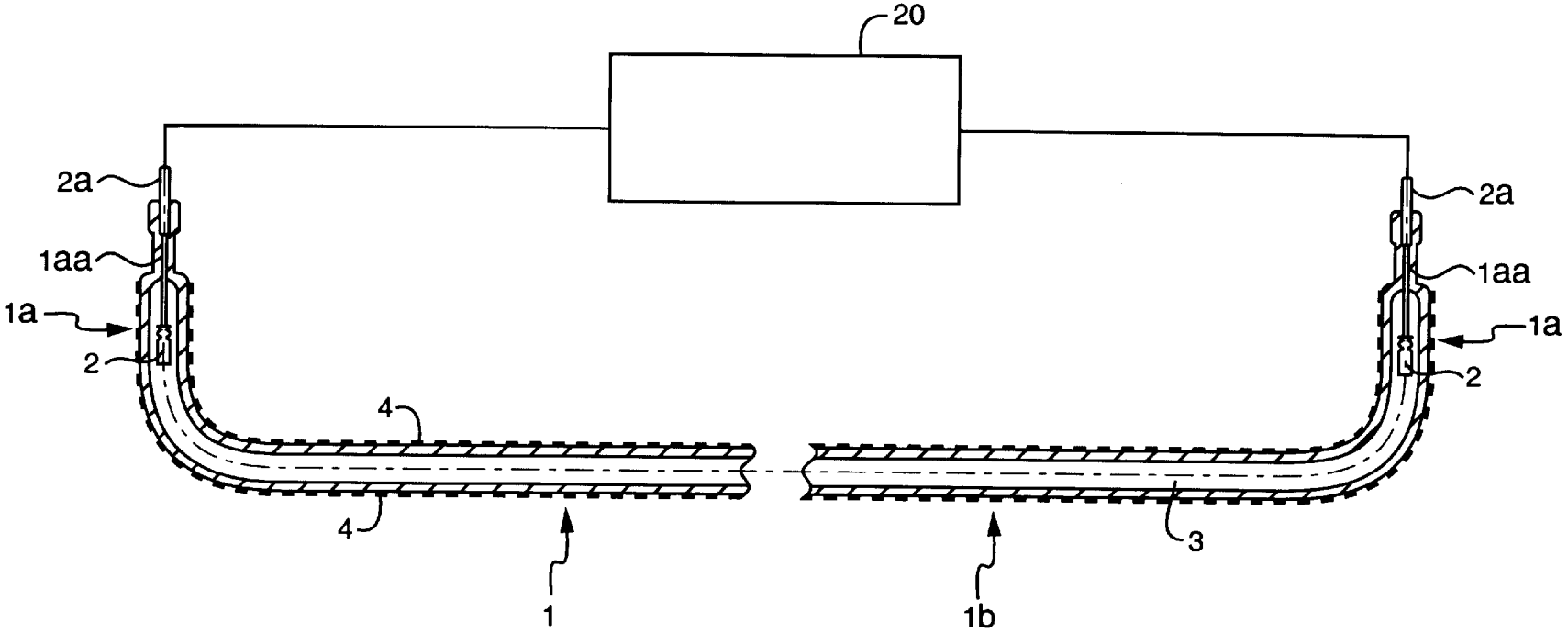
Figure 2:
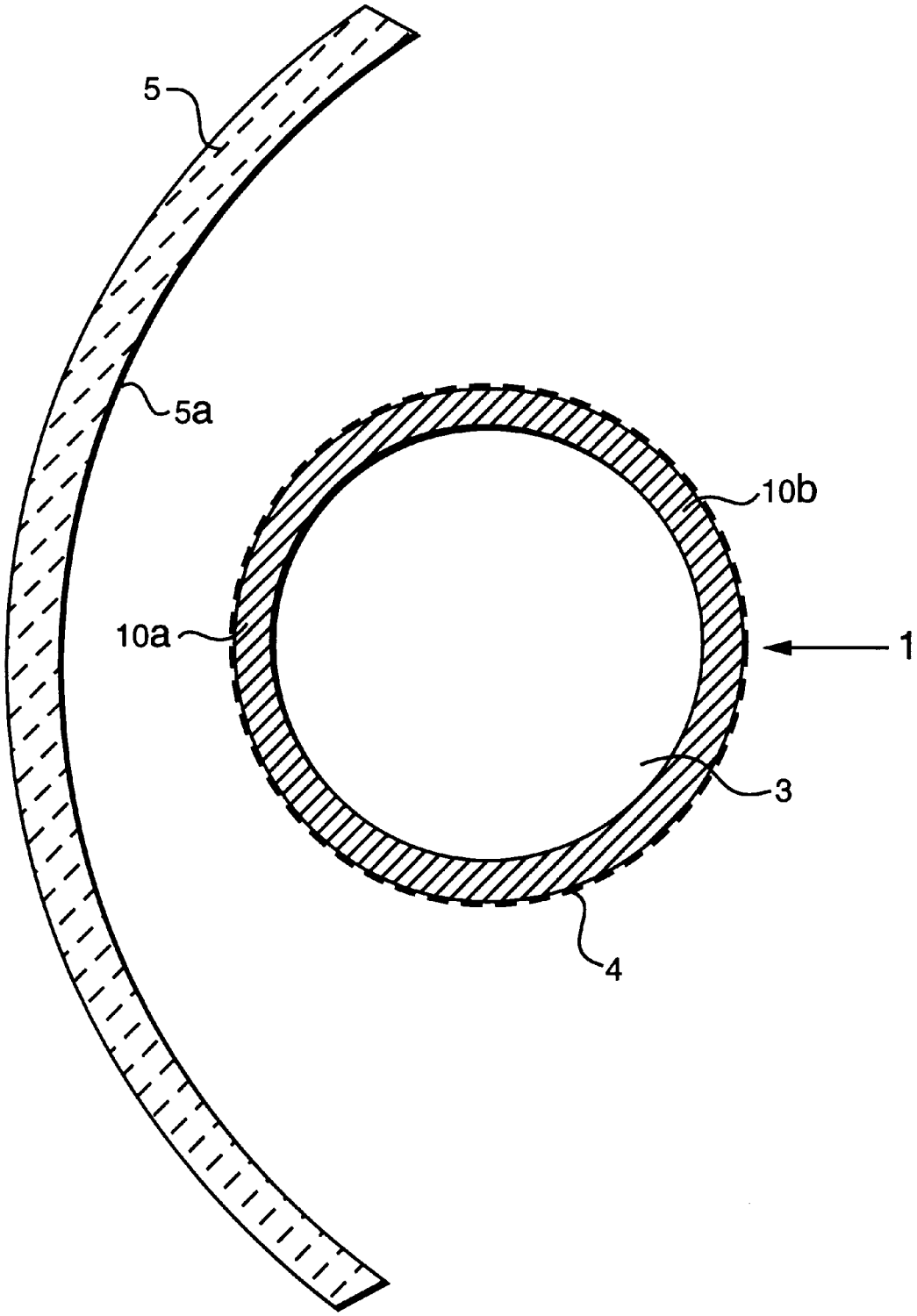
Figure 3:
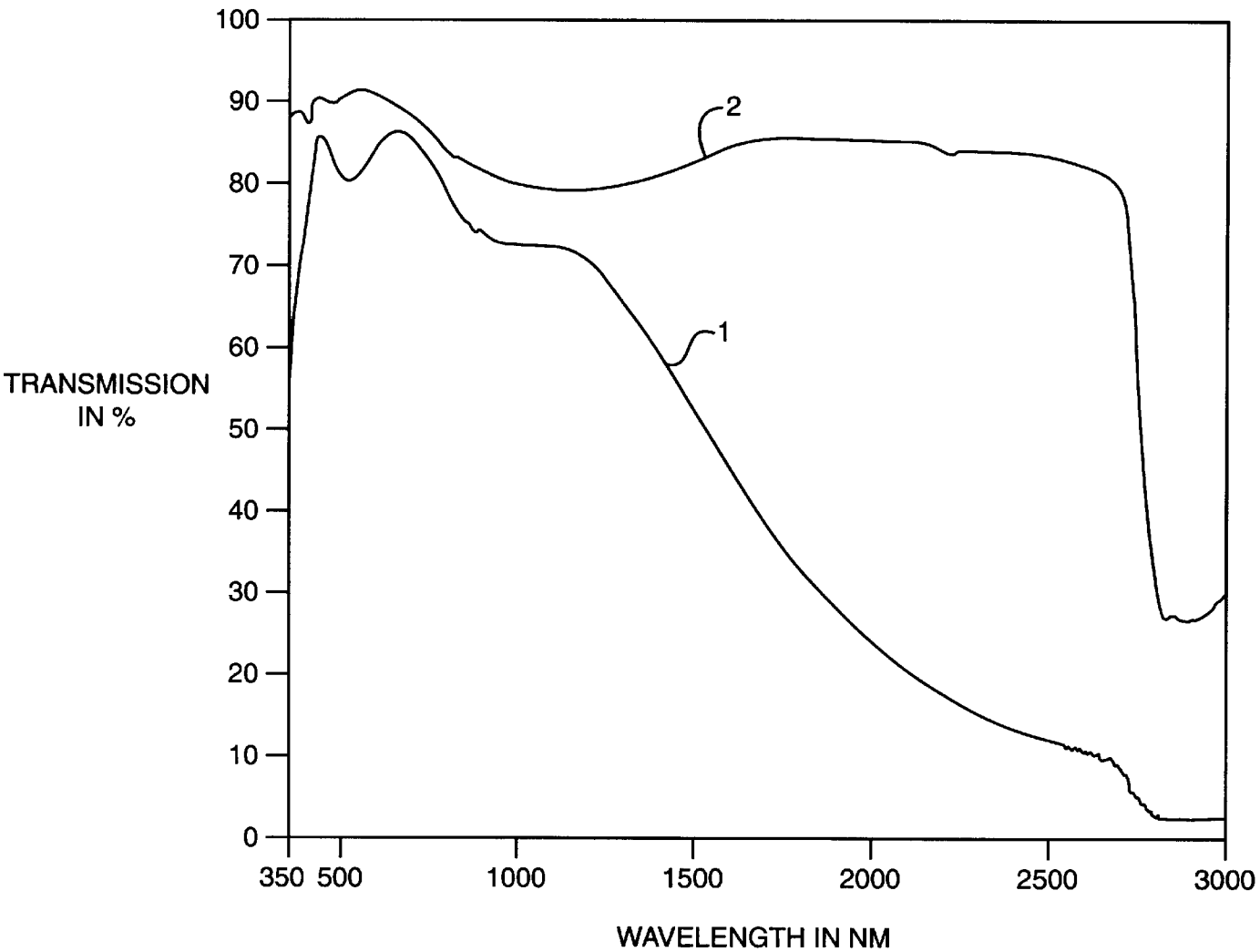

The invention is explained in more detail below using a preferred exemplary embodiment. In the figures:

FIG. 1 shows a longitudinal section through a discharge lamp in accordance with the preferred exemplary embodiment of the invention, in a schematic illustration, FIG. 2 shows a cross section through the discharge lamp in accordance with FIG. 1 with a reflector, in a schematic illustration, FIG. 3 shows transmission curves for the uncoated and the coated lamp vessel.

The preferred exemplary embodiment of the invention represented in FIG. 1 concerns a neon gas discharge lamp. This lamp has a tubular, vitreous discharge vessel 1 having two ends la which are angled away at right angles in the same direction. An electrode system 2 of the neon gas discharge lamp is sealed into each of the ends 1*a* in a gastight manner. The power supply leads 2*a* projecting from the sealing-in region 1*aa* form the electrical terminals of the lamp. The discharge vessel 1 has a circular-cylindrical configuration between its angled-away ends 1*a*. The external diameter of the discharge vessel 1 is approximately 5 mm. The distance between the power supply leads 2*a* corresponds approximately to the length of the circular-cylindrical discharge vessel part 1*b* and is 308 mm. The angled-away ends 1*a* have a length of 36.2 mm.

The outer surface of the discharge vessel 1 is provided with a so-called ITO layer 4—that is to say an indium tin oxide layer—which extends across the entire discharge space 3 of the neon gas discharge lamp, as far as the sealing-in regions 1*aa* of the electrodes 2. The discharge space 3 is in this case defined by the discharge-side ends of the two electrodes 2 and the internal diameter of the discharge vessel 1. The ITO layer 4 has a surface resistivity of 14 ohms per square, as measured by the method of four-point measurement. It comprises 90 percent by weight of indium oxide $In_2O_3$ and 10 percent by weight of tin oxide $SnO_2$. The transmission curve 1 shows the light transmission of the discharge vessel 1 with ITO layer 4 as a function of the wavelength, while the transmission curve 2 shows the light transmission of the discharge vessel without an ITO layer. The layer thickness of the ITO layer is coordinated in such a way that the transmission curve 1 has a transmission maximum at a wavelength of 600 nm, that is to say for red light, which is predominantly emitted by the neon gas discharge lamp. The layer thickness of the ITO layer 4 is therefore approximately 300 nm. In the wavelength range of from 550 nm to 700 nm, the transmission of the coated lamp vessel 1 is more than 80% of the light impinging on the inner wall of the discharge vessel 1, that is to say the transmission coefficient is greater than 0.8 in this wavelength range. A transmission coefficient of more than 0.85 is achieved at the wavelength of 600 nm.

The neon gas discharge lamp described above is preferably part of a lighting system, in particular of a motor vehicle rear luminaire, and serves for producing a rear light and/or or a brake light. In addition to the neon gas discharge lamp, this rear luminaire also comprises an electronic operating unit 20 for the neon gas discharge lamp and a groove-shaped reflector 5 arranged between the angled-away ends 1*a* of the lamp. The circular-cylindrical vessel part 1*b* of the discharge vessel 1 is arranged approximately in the optical axis of the reflector 5. The reflecting surface 5*a* of the reflector 5, which surface faces the lamp, is metallic or metallized and connected to the circuitry-internal ground potential of the operating unit. The ITO layer 4 of the discharge vessel 1 is likewise connected to the circuitry-internal ground potential of the operating unit. The lighting apparatus also has a housing (not represented) whose metallized parts are likewise connected to the circuitry-internal ground potential, with the result that star contact is made at a common ground point. The ITO layer 4 has a smaller layer thickness on the wall regions 10*a* of the discharge vessel 1 which face the reflector 5 than on the wall regions 10*b* of the discharge vessel 1 which are remote from the reflector 5. The layer thickness of the ITO layer 4 has a value of approximately 300 nm on the wall regions 10*b* remote from the reflector 5, while it measures approximately 100 nm on the wall regions 10*a* facing the reflector 5.

The invention is not restricted to the exemplary embodiment explained in more detail above. By way of example, the ITO layer 4 need not extend across the entire discharge vessel 1. It is enough to provide those wall regions of the discharge vessel 1 which enclose the space between the discharge-side ends of the two electrodes 2 with the ITO layer 4.

The invention can also be applied to other types of discharge lamps, for example to low-pressure discharge lamps or to high-pressure discharge lamps and to lighting systems having a high-pressure discharge lamp such as, for example, a motor vehicle headlight furnished with a high-pressure discharge lamp. What is concerned, in particular, in this case is a high-pressure discharge lamp having a base at one end and having a discharge vessel enclosed by a vitreous outer bulb, the outer bulb being provided with a light-transmitting, electrically conductive layer—preferably an ITO layer—extending across the entire discharge space of the lamp. The high-pressure discharge lamp is preferably part of a motor vehicle headlight and is operated from an electronic operating unit. The light-transmitting, electrically conductive layer on the outer bulb of the high-pressure discharge lamp is connected to the circuitry-internal ground potential of the operating unit.

Instead of an ITO layer, it is also possible to use light-transmitting, electrically conductive layers which are composed of a different material, for example of tin oxide $SnO_2$ or of fluorine- or antimony-doped tin oxide $SnO_2$:F or $SnO_2$:Sb, respectively.

What is claimed is:

1. A lighting system having a discharge lamp with at least one light-transmitting lamp vessel (1) enclosing a discharge space (3) in the discharge lamp, a luminous means and electrical terminals (2*a*) for supplying voltage to the discharge lamp, wherein the at least one lamp vessel (1) has a light-transmitting, electrically conductive layer (4) extending at least across the entire discharge space (3) of the discharge lamp wherein the lighting system has an operating unit for the discharge lamp, and has a reflector (5) with a metallic or metallized reflecting surface (5*a*) and the at least one lamp vessel (1) has wall regions (10*a*) facing the reflector and wall regions (10*b*) remote from the reflector (5), the layer thickness of the light-transmitting, electrically conductive layer (4) on the wall regions (10*a*) facing the reflector (5) being less than the layer thickness of the light-transmitting electrically conductive layer (4) on the wall regions (10*b*) remote from the reflector (5).

2. The lighting system as claimed in claim 1, wherein the at least one lamp vessel (1) has at least one sealed end (1*a*) with a sealing-in region (1*aa*) for an electrode system (2), and wherein the light-transmitting, electrically conductive layer (4) extends as far as the sealing-in region (1*aa*).

3. The lighting system as claimed in claim 1, wherein the light-transmitting, electrically conductive layer (4) is arranged on the outer surface of the at least one lamp vessel (1).

4. The lighting system as claimed in claim 1, wherein the surface resistivity of the layer (4) is less than 100 ohms per square.

5. The lighting system as claimed in claim 1, wherein the layer (4) is an ITO layer, that is to say an indium tin oxide layer.

6. The lighting system as claimed in claim 1, wherein the lamp is a neon gas discharge lamp.

7. The lighting system as claimed in claim 6, wherein the transmission coefficient of the at least one lamp vessel (1) in the wavelength range of from 550 nm to 700 nm is greater than 0.8.

8. The lighting system as claimed in claim 1, wherein the discharge lamp is a high-pressure discharge lamp.

9. The lighting system as claimed in claim 8, wherein the high-pressure discharge lamp has an outer bulb enclosing the discharge vessel and the light-transmitting, electrically conductive layer is arranged on the outer bulb of the high-pressure discharge lamp.

10. The lighting system as claimed in claim 1, wherein the light-transmitting, electrically conductive layer (4) is connected to a predetermined electrical reference-ground potential.

11. The lighting system as claimed in claim 10, wherein the predetermined electrical reference-ground potential is the circuitry-internal ground potential of the operating unit, or the ground potential.

12. The lighting system as claimed in claim 11 wherein the reflector (5) is connected to the predetermined electrical reference-ground potential.

13. The lighting system as claimed in claim 1, wherein the layer thickness of the light-transmitting, electrically conductive layer (4) on the wall regions (10*b*) of the at least one lamp vessel which are remote from the reflector (5) is 300 nm.

* * * * *